United States Patent [19]

Simeone

[11] 3,930,331

[45] Jan. 6, 1976

[54] TOY FOR KNOT TYING

[76] Inventor: Janet A. Simeone, 7067 Devon Way, Berkeley, Calif. 94705

[22] Filed: Feb. 14, 1974

[21] Appl. No.: 442,417

[52] U.S. Cl. ..... 46/1 R; 46/151; 46/116; 35/8 R

[51] Int. Cl.[2] ..... A63H 33/00

[58] Field of Search ..... 46/1, 151, 116; 35/8 R, 35/56, 57

[56] References Cited

UNITED STATES PATENTS

| | | | |
|---|---|---|---|
| 1,336,898 | 4/1920 | Flynn | 46/151 |
| 1,549,035 | 8/1925 | Van Laar | 46/151 |
| 2,180,653 | 11/1939 | Yancey et al. | 35/8 R |
| 2,628,452 | 2/1953 | Gladstein | 46/116 |

*Primary Examiner*—Louis G. Mancene
*Assistant Examiner*—Robert F. Cutting

[57] ABSTRACT

A long loop of tubular textile material stuffed with fiber, foam or a cotton rope passes through a cushion body, so as to form a handle at the top and dangling legs at the bottom. The bottom of the cushion is straight and the remainder of the edge is a curve from the summit of which the handle protrudes. Features of a face and hands are provided on the front of the cushion. A pocket on the back, open to the top, is large enough for inserting the end portion of the dangling legs, and thereby giving the toy an attractive rest position. The toy thus has some aspects of a fanciful stuffed animal type doll, a handbag and a cushion, but it is designed to induce its child possessor to use the dangling legs for practice in tying knots.

8 Claims, 4 Drawing Figures

FIG. 1
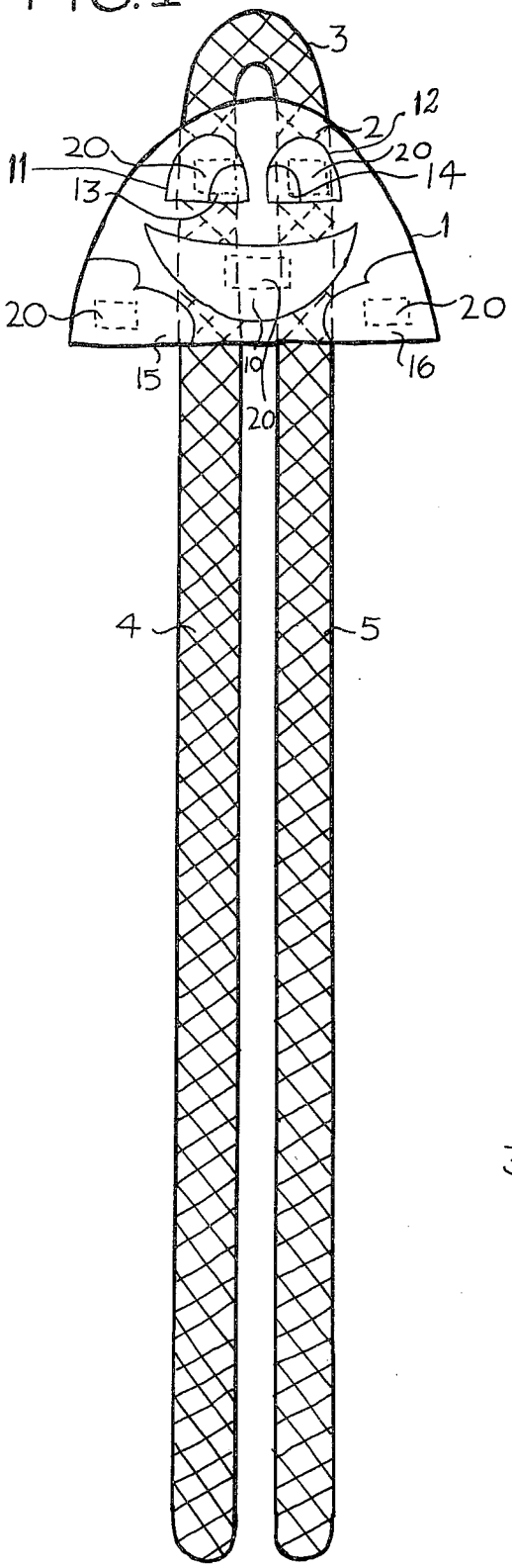
FIG. 2
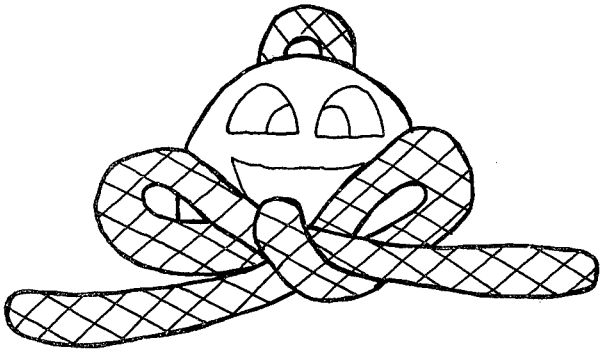
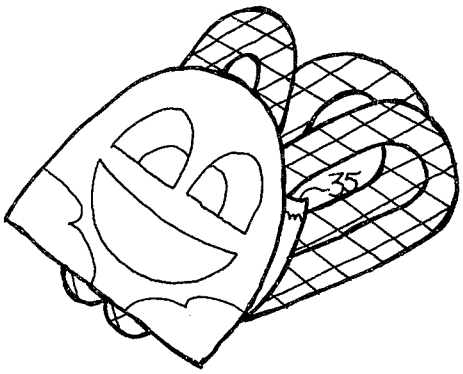
FIG. 3
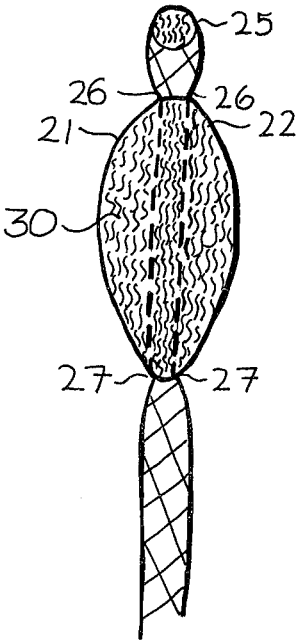
FIG. 4

TOY FOR KNOT TYING

This invention concerns an educational toy representing a fanciful being and having some attributes of a pillow, preferably also of a handbag, and being distinguished particularly by long dangling legs suitable for a child's practice in tying knots.

For teaching children the tying of knots and shoelaces, neckties, hair bows, and the like, it is desirable to utilize ropes at least as heavy as clothsline both for demonstration and practice, so that the course of each rope in a knot can readily be seen. According to the present invention it is desirable for this purpose to utilize ropes of relatively large girth having great flexibility to make such ropes available to children in a more attracting and intriguing form than ordinary rope.

It is an object of the present invention to provide an educational toy of a kind which the child will like to have with him because of its appeal to his fancy and which will put at his disposal material and occasions for practicing the tying of common useful knots.

SUBJECT MATTER OF THE PRESENT INVENTION

Briefly, a soft decorated body in the form of a cushion, either permanently decorated on at least one side in the form of a fanciful face, or else provided with means for attaching the features of a face, is made around a loop of thick and very flexible material, which may be a loop of tubular material that encloses a very flexible rope or is stuffed with a soft filling at least in the portions outside of the cushion body. The loop is fastened to the cushion body at the places where it enters and leaves the latter and is disposed, so that a closed end of the loop extends a little way above the middle of one edge of the cushion body, while the other end of the loop is open, and the greater portion of the loop lies between the cushion body and the open end. The cushion body is preferably of half-moon shape, with the legs dangling from the straight side.

The invention is further described by way of specific example with reference to the accompanying drawing, in which:

FIG. 1 is a front elevation view of the educational fanciful doll of the present invention in extended position;

FIG. 2 is a front view of the educational fanciful doll of the invention in a carrying position;

FIG. 3 is a perspective view of the doll of FIGS. 1 and 2 in a set-up rest position, and FIG. 4 is a median cross-section, partly broken away, of the doll of FIGS. 1, 2 and 3.

FIG. 1 shows a fanciful educational doll, illustrating the invention, composed of a half-moon cushion-like body 1 and a thick rope loop 2 passing through the half-moon body 1 to form a handle 3 and long dangling legs 4 and 5. The loop 2, including the handle and the legs, is made of a tubular material preferably a textile material that is soft and pleasant to touch and decorated in an attractive consistent pattern generally indicated in FIG. 1 by the criss-cross pattern shown. The leg and handle portions are stuffed with a soft filling such as a cotton rope, polyester or other synthetic fiber, kapok or injected fiber shreds or flexible plastic foam. A cotton rope is at present preferred, but other suitable materials may be cheaper. The stuffing of the loop 2 may continue right through the portion of the loop inside the half-moon body 1 or it may be omitted for that interior portion, in which case the tubular material of the loop still continues right through. It is essential that at least the stronger part of the loop rope should continue right through from handle to legs in order to make the article sturdy enough for rough use and to simplify the fastening to the cushion body. The loop is preferably stitched to the covering of the half-moon body where it passes through the covering, and it is convenient to pinch the loop somewhat where it is stitched.

The half-moon body 1 is made as a small pillow, preferably with two roughly half-moon shaped pieces of felt stitched together around the edges and, as mentioned before, stitched to the loop 2 where it passes through the edges of the half-moon body. Instead of felt, corduroy or a pile fabric could be used, or a synthetic material flocked on the surface to provide a soft surface that does not feel cold or clammy. The interior of the half-moon body 1, like the loop 2, is stuffed with a soft material, such as polyester fiber, kapok or an injected shredded fiber or foam material.

The contour of the half-moon body is not necessarily strictly semicircular. In fact, the height is desirably made a little more than half the width. For a width of about 11 inches and a height of about 7 inches, for example, the thickness in the center of the cushion body may conveniently be about 3 inches. These dimensions are of course only illustrative, for the article can be made in a variety of sizes. The length of the dangling legs may typically be between 20 and 30 inches, although in the interest of variety shorter or longer legs might be used.

The half-moon body is provided with patches of bright colors, including a path 10 simulating a mouth, patches 11 and 12 simulating eyeballs, patches 13 and 14 simulating the central part of the eye and patches 15 and 16 representing hands. The features shown in FIG. 1 are purely illustrative. Further detail may be shown in the eye, distinguishing pupil from iris, and further detail may be shown in the mouth rather than a single solid color patch. Various models of fanciful faces, some with moustache or beard, some with indication of a hair line, may be provided. The patches may be of the same type of felt as the covering of the half-moon body, but in contrasting colors, and may be simply stitched on. A further educational entertainment feature can be provided by applying to the half-moon body patches of a hook material, such as the kind sold under the trade name VELCRO. In that case patches to designate the face and hand features would be detached and would on their undersides have an open-felted material, such as is commonly used for engaging the above-mentioned hooked material. The combination of the open-felted material and the hooked material acts like a pressure sensitive adhesive. When one is applied to the other they stick together, but with a pull from one edge they can be disengaged. In fact all of one of both surfaces of the half-moon body may be coated with one of these materials, so that various kinds of patches can be placed anywhere on its surface. On the other hand, even if small patches of hooked material, as indicated in dashed lines at 20, are used on the half-moon body in FIG. 1, a certain variety in angular position to indicate slight differences in facial expression can be provided by the child applying the feature patches to the half-moon body.

FIG. 2 shows the educational fanciful doll of this invention with the dangling legs tied into a bow knot. The legs would normally be tied in this or some similar fashion for carrying the doll around without dragging the legs.

FIG. 3 illustrates one reason why a pocket is provided on at least one side of the half-moon body. In FIG. 3 the ends of the dangling legs are stuffed into the pocket forming a pair of loops out of the remainder of the legs, which can then serve as a stand for holding the half-moon body with the face features exposed in a slightly reclining but essentially erect position. In this way the fanciful figure can be given a pleasing aspect on a dresser or table, while it is not being played with.

The pocket is also useful for educational purposes to teach counting when the child puts small articles in the pocket counting them in, counting part of them out and then counting the remainder out, and so on. The child may also use it to carry small articles around. This is of particular interest in getting girls accustomed to carrying a handbag and both boys and girls to carrying various school requirements around.

FIG. 4 is a cross-section down the middle of the article on a plane perpendicular to the front face. The two covering surfaces of the half-moon body are indicated at 21 and 22. The patches indicating face features on the half-moon body have been omitted for simplicity of illustration. The loop forming the legs is shown in cross-section, as it is cut by the cross-section plane at 25. For simplicity in stitching it to the half-moon body, the loop is pinched at 26 and 27. The interior of the half-moon body is filled with polyester fiber shown symbolically at 30.

A large patch 35 stitched on the back of the half-moon body at the bottom and sides, forms a patch pocket covering most of the back surface. The same type of soft-surfaced material, such as felt, used for the covering of the half-moon body is also used for the patch pocket. The patch pocket covers most of the surface of the back side of the doll in this illustrative embodiment, but does not cover the upper portion of the half-moon body near the handle, so that the pocket would not be excessively deep and can have quite a wide opening. Of course the fanciful doll of this invention can also be provided with a pocket on both sides of the half-moon body, since the front pocket could be extensive enough in area to carry all the face features.

Other variations that do not depart from the inventive concept are, for example, the provision of pieces of felt, closth or fabric on the ends of the dangling legs to simulate feet, provision of a ruffle at the bottom of the half-moon body, provision of dangling hands instead of the patches 15,16, provision of a third long cord simulating a pigtail of hair coming out of the back of the head, so that the child can use it to practice braiding with the other two (leg) ropes, and so on. When two of the fanciful dolls of this invention are available, a child can use three of the four legs to practice braiding.

The fanciful educational doll of this invention has the advantage of combining an intriguing appearance and a wide variety of ways of use. It can even be used as a decorative pillow for a family room sofa or chair.

Although the invention has been described by way of example, it is to be understood that various modifications may be made within the inventive concept without departing from the spirit of the invention. For example, a cotton rope not covered with a decorative textile could be used to provide the loop forming the handle and dangling legs.

Both the stuffed tube form and the plain rope form of the leg and handle member may be generally referred to as a loop of rope. For the purpose of this invention, the word "rope" is used in the modern sense without necessarily meaning a twisted or stranded body.

I claim:

1. An educational doll toy for encouraging practice in knot-tying, comprising:

a long open loop of highly flexible material, held together in the general form of a thick rope, said loop having a bend in the middle so as to provide legs of substantially equal lengths, and a soft cushion body through which the legs of said rope loop pass and to which said rope loop legs are fastened in such a way that the closed end of the loop forms a short handle of the same material as the legs and integral therewith and the greater part of the legs of the loop dangle from the edge of the cushion body opposite to the edge from which the handle protrudes, the dangling portion of the length being of sufficient length, and being sufficiently limp, for the tying of a full bow knot therewith;

said cushion body having a contour composed of a substantially straight portion from which the loop legs dangle and an arcuate portion from the middle part of which the handle-forming closed loop end protrudes, which contour provides said body with a roughly half-moon cushion shape.

2. An educational doll toy as defined in claim 1 in which said cushion body has a pocket on one side open to the top, the top being defined by the position of said handle, said pocket being of a size sufficient for insertion of a substantial length on the tips of said dangling legs.

3. An educational doll toy as defined in claim 2 in which the outside cover material of said cushion and also the material forming said pocket is a textile material.

4. An educational toy as defined in claim 3 in which at least one side of said cushion body is decorated to represent features of a fanciful face.

5. An educational toy as defined in claim 3 in which patches of a material designed to produce adhesion by dry engagement with another particular material are provided on at least one side of said cushion body and disposed for attachment by dry adhesion of textile patches representing features of a face.

6. An educational toy as defined in claim 2 in which one side of said cushion body is formed of a material providing a plurality of small filament loops suitable for engagement with decorative patches provided on their undersides with a material providing a multiplicity of small hooks.

7. An educational toy as defined in claim 2 in which said rope loop comprises a tubular textile covering and a filling, said filling being provided at least in the portions of said loop outside of said cushion body and being of a material selected from the group consisting of natural and synthetic textile fibers and flexible synthetic resin foam.

8. An educational doll toy as defined in claim 2 in which said cushion body has a filling of the material selected from the group consisting of natural and synthetic textile fibers and flexible synthetic resin foam.

* * * * *